US008264511B2

(12) United States Patent
Yoshimura et al.

(10) Patent No.: US 8,264,511 B2
(45) Date of Patent: Sep. 11, 2012

(54) PRINTING APPARATUS AND THERMAL TRANSFER PRINTING METHOD

(75) Inventors: Yoshihiro Yoshimura, Kanagawa (JP); Yoshihiro Okamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 281 days.

(21) Appl. No.: 12/792,389

(22) Filed: Jun. 2, 2010

(65) Prior Publication Data

US 2010/0321460 A1 Dec. 23, 2010

(30) Foreign Application Priority Data

Jun. 17, 2009 (JP) ..... 2009-143969

(51) Int. Cl.
*B41J 2/325* (2006.01)

(52) U.S. Cl. ..... 347/198; 347/212

(58) Field of Classification Search ..... 347/171, 347/172, 174, 176, 212, 215, 218, 198; 400/120.17
See application file for complete search history.

(56) References Cited

U.S. PATENT DOCUMENTS 5,392,059 A * 2/1995 Ueno et al. ..... 347/188
8,106,932 B2 * 1/2012 Yoshimura ..... 347/193

FOREIGN PATENT DOCUMENTS

| | | |
|---|---|---|
| JP | 08-080685 | 3/1996 |
| JP | 2004-181888 | 7/2004 |
| JP | 2005-169945 | 6/2005 |
| JP | 2006-096024 | 4/2006 |

* cited by examiner

*Primary Examiner* — Huan Tran
(74) *Attorney, Agent, or Firm* — SNR Denton US LLP

(57) ABSTRACT

Provided is a printing apparatus including: a medium transporting unit configured to transport a printing target medium; a sheet traveling unit configured to allow a thermal transfer sheet, in which a color material layer and a protection layer are formed on a sheet in a line along a travel direction, to travel; a printing unit configured to sequentially and thermally transfer the color material layer and the protection layer onto the printing target medium by applying thermal energy to the printing target medium and the thermal transfer sheet which are sandwiched by the printing unit; and a pressure changing mechanism configured to change the sandwiching force acting on the printing target medium and the thermal transfer sheet so as to have a relationship of force P1<force P2.

4 Claims, 7 Drawing Sheets

FIG. 3A

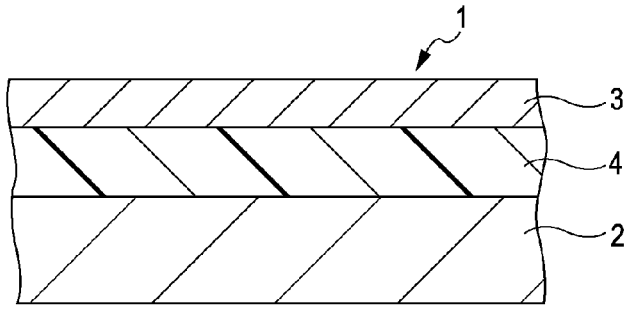

FIG. 3B

| CONSTITUTION | PORTION |
|---|---|
| HOLLOW PARTICLE EMULSION (PRODUCT NAME: Nipol MH5055, ZEON Corporation.) | 50 |
| POLYVINYL ALCOHOL (PRODUCT NAME: GOSENOL GH-17, Nippon Synthetic Chemical Industry Co. Ltd.) | 5 |
| ACRYLONITRILE BUTADIENE LATEX (PRODUCT NAME: Nipol1561, ZEON Corporation.) | 30 |
| WATER | 200 |

FIG. 3C

| CONSTITUTION | PORTION |
|---|---|
| POLYESTER RESIN (PRODUCT NAME: VYLON 220, TOYOBO Co. Ltd.) | 100 |
| SILICON OIL (PRODUCT NAME: KF-8010, Shin-Etsu Chemical Co. Ltd.) | 2 |
| CROSS-LINKING AGENT (PRODUCT NAME: TAKENATED-140N, Takeda Pharmaceutical Co. Ltd.) | 10 |
| METHYLETHYLKETONE | 100 |
| TOLUENE | 100 |

UNIFORM HEAD PRESSURE

LARGE HEAD PRESSURE

FIG. 8

| | HEAD PRESSURE DURING TRANSFER OPERATION OF COLOR MATERIAL LAYER (MPa) | HEAD PRESSURE DURING TRANSFER OPERATION OF PROTECTON LAYER (MPa) | PRINTING SPEED DURING TRANSFER OPERATION OF PROTECTION LAYER (msec/line) | PROTECTION LAYER PATTERN | EVALUATION 1 (DENT) | EVALUATION 2 (MATT TONE) |
|---|---|---|---|---|---|---|
| FIRST EMBODIMENT | 1.2 | 1.8 | 0.7 | GLOSSY | ○ | — |
| SECOND EMBODIMENT | 1.2 | 1.8 | 0.7 | MATT | — | ○ |
| THIRD EMBODIMENT | 1.2 | 1.8 | 4.0 | MATT | — | ◎ |
| COMPARATIVE EXAMPLE 1 | 1.2 | 1.2 | 0.7 | GLOSSY | × | — |
| COMPARATIVE EXAMPLE 2 | 1.2 | 1.2 | 0.7 | MATT | — | × |
| COMPARATIVE EXAMPLE 3 | 1.2 | 1.2 | 4.0 | MATT | — | △ |

PRINTING APPARATUS AND THERMAL TRANSFER PRINTING METHOD

BACKGROUND OF THE INVENTION

1. Field of the Invention

The present invention relates to a printing apparatus which performs a printing operation through a thermal transfer technique and a thermal transfer printing method which is used in the printing apparatus.

2. Description of the Related Art

In recent years, in accordance with the supply of digital cameras, there is an increasing demand for a photographic print similar to high-quality silver halide photography. As printing technologies for satisfying the demand for this photographic print, for example, there exists a printing technology of a thermal transfer type such as a thermal sensitive type, a thermal melting type, or a sublimation type.

In the printing technology of the thermal transfer type, for example, in the sublimation type, thermal energy controlled by an image signal is applied to a thermal head, and a color material (dye ink) on a thermal transfer sheet is sublimated in response to the thermal energy. Then, the sublimated color material is transferred onto a printing target medium. In this manner, a printing operation is performed on the printing target medium. According to the printing technology, since the color material in use is a dye ink, the color material is very clear and has excellent transparency. In addition, since it is possible to adjust the ink amount by minutely controlling the applied heat amount, the obtained image has an excellent grayscale property and reproducibility of neutral color. That is, it is possible to form an image similar to the silver halide photography.

Generally, the printing target medium used in the printing operation in the thermal transfer type includes an air gap layer which has a heat insulation function and is provided as an intermediate layer in addition to a dye storing layer for storing the color material. The air gap layer holds a heat generated from the thermal head so as to highly efficiently obtain thermal energy necessary for the transfer operation of the color material. For this reason, as the air gap layer, for example, a film provided with air gaps formed by adding microscopic particles to a thermoplastic resin and two-axially stretching the result, or a layer coated with a result formed by mixing hollow particles with a binder resin is used.

In detail, there is a proposal in which a polyethylene terephthalate (hereinafter, referred to as "PET") film having a specific weight is used as a film for the air gap layer (for example, refer to JP-A-2004-181888). In addition, there is a proposal in which a thermal transfer receiving sheet has a sheet-like support formed of a cushion layer containing hollow particles and a thermoplastic resin film layer which are stacked sequentially on at least one side of a core layer, and an image receiving layer formed on the thermoplastic resin film layer, and the thermoplastic resin film layer is stacked on the cushion layer with an adhesive layer therebetween (for example, refer to JP-A-2005-169945). Further, there is a proposal in which a thermal transfer image receiving sheet provided with an image receiving layer provided on a support formed by pulp paper mainly containing wood pulp and synthetic pulp and receiving a dye transferred from a thermal transfer medium at the time of heating by thermal melting or sublimation, an intermediate layer is provided between a support and the image receiving layer, and the intermediate layer mainly contains the spherical hollow particles and the rubber elastomer fine particles (for example, refer to JP-A-H08-80685). Furthermore, there is a proposal in which a thermal transfer receiving sheet has a partition wall made of a polymeric material and keeps at least one side surface of a sheet-like support successively overlaid with an intermediate layer containing a hollow particle having pores inside and an image receiving layer, and, as the hollow particles, the intermediate layer contains at least hollow particles in which the partition wall is formed by the polymeric material having a glass transition temperature of 130° C. or more (for example, refer to JP-A-2006-96024).

SUMMARY OF THE INVENTION

Incidentally, for example, in the printing method of the sublimation type, a sublimation dye for each of the color components of yellow, magenta, and cyan is sublimated by thermal energy applied from the thermal head so as to form an image to be printed on the printing target medium having a dye storing layer. Accordingly, a relatively large amount of thermal energy is supplied to a high density image portion, and a small amount of thermal energy is supplied to a low density image portion.

Meanwhile, as described above, the printing target medium having an image formed thereon is provided with the air gap layer (or the intermediate layer) in addition to the dye storing layer. However, generally, the heat resistance of the air gap layer provided in the printing target medium is not excellent. The same applies to the configuration disclosed in JP-A-2004-181888, JP-A-2005-169945, JP-A-H08-80685, and JP-A-2006-96024.

Accordingly, in the case of performing a printing operation on the printing target medium provided with the air gap layer, the air gap layer may be crushed by the pressure applied from the thermal head and the thermal energy applied from the thermal head during the transfer operation of the color material. In addition, the crushing amount of the air gap layer is proportional to the magnitude of the thermal energy.

For this reason, in the printed printing target medium, for example, unevenness may exist at the boundary of the image density such that the crushing amount is large at the high density image portion, and the crushing amount is small at the low density image portion. Since the unevenness degrades the quality of the printed image, it is necessary to prevent the generation thereof.

Therefore, it is desirable to provide a printing apparatus and a thermal transfer printing method capable of suppressing the generation of the unevenness at the boundary of the image density on the printing target medium caused by a difference in the applied thermal energy, where the difference may be generated between the high density image portion and the low density image portion upon performing the printing operation through a thermal transfer technique.

A printing apparatus according to an embodiment of the invention includes: a medium transporting unit configured to transport a printing target medium; a sheet traveling unit configured to allow a thermal transfer sheet, in which a color material layer and a protection layer are formed on a sheet in a line along a travel direction, to travel; a printing unit configured to sequentially and thermally transfer the color material layer and the protection layer onto the printing target medium by applying thermal energy to the printing target medium and the thermal transfer sheet which are sandwiched by the printing unit; and a pressure changing mechanism configured to change the sandwiching force acting on the printing target medium and the thermal transfer sheet so as to have a relationship of force P1<force P2, where the force P1 is a force during a thermal transfer operation of the color material layer, and the force P2 is a force during a thermal transfer operation of the protection layer.

In the printing apparatus having the above-described configuration, after the thermal transfer operation of the color material layer is performed on the printing target medium, the thermal transfer operation of the protection layer is performed on the printing target medium. At this time, although there is a difference in the thermal energy applied to the high density image portion and the low density image portion during the thermal transfer operation of the color material layer, a uniform thermal transfer operation is performed on the entire surface of the printing target medium during the thermal transfer operation of the protection layer. Further, the force P1 during the thermal transfer operation of the color material layer and the force P2 during the thermal transfer operation of the protection layer have a relationship of force P1<force P2. Accordingly, even when unevenness is formed at the boundary between the high density image portion and the low density image portion during the thermal transfer operation of the color material layer, the unevenness is smoothened by the sandwiching force and the thermal energy applied during the thermal transfer operation of the protection layer. In addition, since the smoothening operation is performed during the thermal transfer operation of the protection layer, it is not necessary to prepare a process step for the smoothening operation in addition to the thermal transfer operations of the color material layer and the protection layer.

According to the embodiment of the invention, the unevenness which may be generated on the printing target medium during the thermal transfer operation of the color material layer is smoothened during the thermal transfer operation of the protection layer. Accordingly, in the case of the printing operation through a thermal transfer technique, even when there is a difference in the thermal energy applied to the high density image portion and the low density image portion during the thermal transfer operation of the color material layer, it is possible to suppress the generation of the unevenness at the boundary of the image density caused by the difference. Further, since the smoothening operation is performed during the thermal transfer operation of the protection layer, the printing productivity is not degraded due to the thermal transfer operation.

BRIEF DESCRIPTION OF THE DRAWINGS

FIGS. 3A, 3B, and 3C are explanatory diagrams showing a detailed configuration example of a roll paper used as a printing target medium in the printer according to the invention;

FIG. 8 is an explanatory diagram showing a detailed example of a matt image evaluation result and a dent evaluation result of printed matter obtained by the printer according to the invention.

DESCRIPTION OF THE PREFERRED EMBODIMENTS

Hereinafter, modes (hereinafter, referred to as "embodiments") for carrying out embodiments of the invention will be described. In addition, the description thereof is made in accordance with the following sequence.

1. First Embodiment (schematic configuration example of printing apparatus, configuration example of main part of printing apparatus, configuration example of printing target medium, and process operation example of printing apparatus)
2. Second Embodiment
3. Third Embodiment
4. Detailed Example

1. First Embodiment

Schematic Configuration Example of Printing Apparatus

First, a schematic configuration of a printing apparatus according to an embodiments of the invention will be described by exemplifying a sublimation-type thermal printer.

The sublimation-type thermal printer (hereinafter, simply referred to as a "printer") is configured to perform a printing operation in such a manner that sublimation dye ink applied to an ink ribbon is sublimated by using thermal energy inside a thermal head so as to be transferred onto a printing target medium when a current is supplied to heating elements. A roll paper is used as the printing target medium. A roll paper formed as a roll shape and set in a sheet feeding cassette is extracted and fed from the sheet feeding cassette in accordance with necessity.

Figure 1:
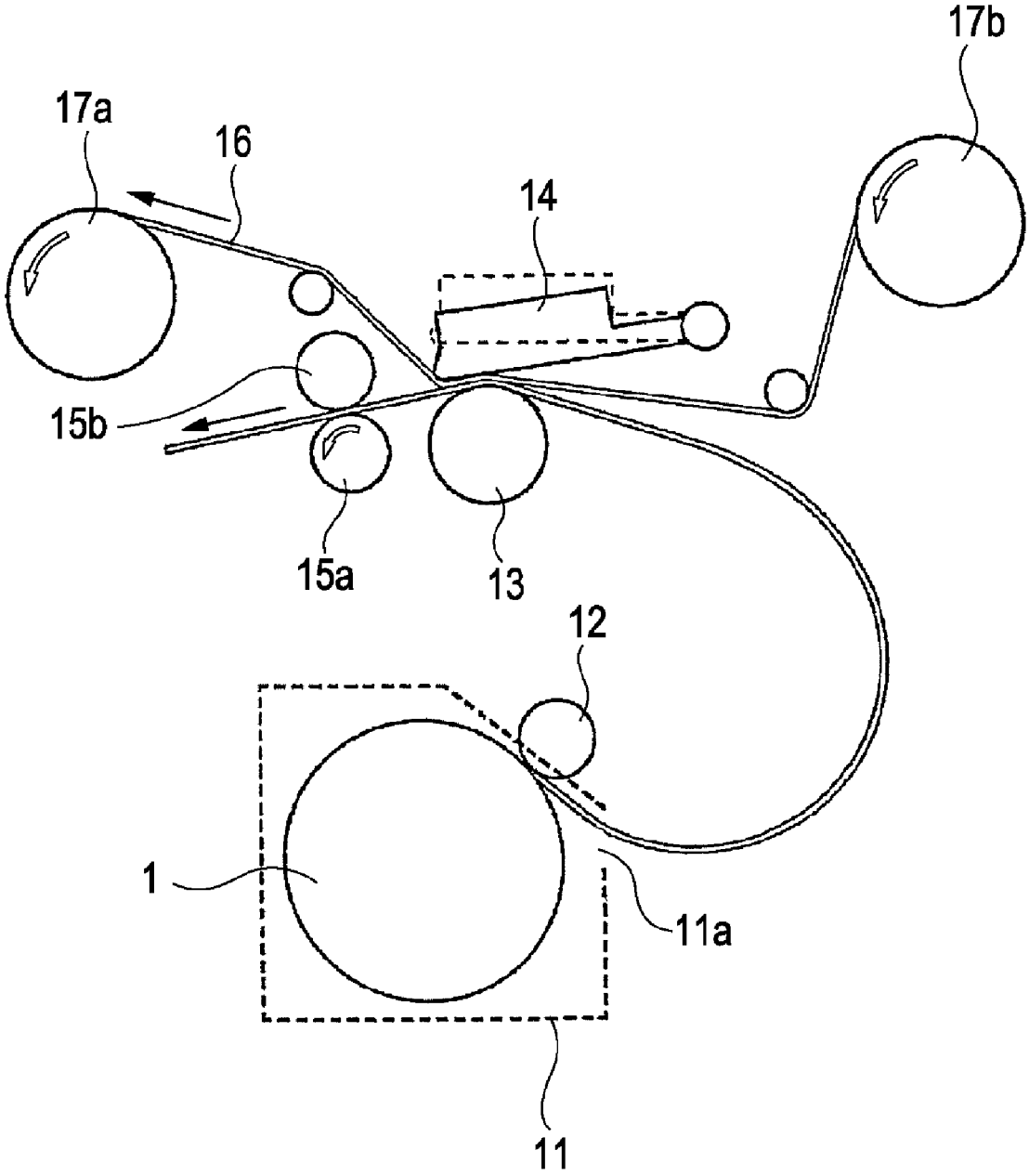
FIG. 1 is a side sectional view showing a schematic configuration example of a printer according to the invention.

FIG. 1 is a side sectional view showing a schematic configuration example of the printer according to the invention.

In the printer as an example shown in the drawing, a roll paper 1 is accommodated in a sheet feeding cassette 11. In this state, when a sheet feeding roller 12 is rotationally driven, the roll paper 1 is continuously sent out from the sheet feeding cassette 11 so as to be discharged from a sheet feeding opening 11*a* of the sheet feeding cassette 11.

The roll paper 1 discharged from the sheet feeding opening 11*a* passes a gap between a platen 13 and a thermal head 14, and is transported by a grip roller 15*a* and a pinch roller 15*b*. That is, the sheet feeding roller 12 for continuously sending out the roll paper 1 and the grip roller 15*a* and the pinch roller 15*b* for transporting the continuously sent-out roll paper 1 serve as a medium transport unit which transports the roll paper 1.

In addition, a transportation path from the sheet feeding opening 11*a* of the sheet feeding cassette 11 to the gap between the platen 13 and the thermal head 14 may be provided with a folding-back portion which turns back the transportation direction of the roll paper 1. By providing the folding-back portion, it is possible to efficiently take advantage of the limited space inside the printer, and to dispose the sheet feeding cassette 11, the sheet discharge tray, and the like toward the same direction (the front side of the apparatus). Accordingly, it is possible to improve operability. In addition, if the path of the folding-back portion is curved in a direction opposite to the winding direction of the roll paper 1, curl correction is performed on the roll paper 1 when the roll paper 1 passes therethrough.

In addition, an ink ribbon 16 also passes between the platen 13 and the thermal head 14 in addition to the roll paper 1.

In the ink ribbon 16, a color material (dye ink) layer provided for each of the ink colors of yellow, magenta, and cyan and a protection layer for a lamination process are disposed in a line on a sheet as a base in a travel direction of the ink ribbon 16. That is, the ink ribbon 16 serves as a thermal transfer sheet where the color material layer and the protection layer are formed in a line on the sheet in the travel direction.

When the ink ribbon 16 is received in the ribbon cassette and is drawn out from a supply reel 17*a*, the ink ribbon is guided by each of the guide rollers to be sequentially fed to a winding reel 17*b* through a gap between the platen 13 and the thermal head 14. That is, the supply reel 17*a* and the winding reel 17*b* of the ink ribbon 16 serve as a sheet traveling unit which allows the ink ribbon 16 to travel.

In addition, during a non-printing operation, the thermal head 14 moves up so as to be located at a position slightly distant from the platen 13, in response to a printing command. However, during a printing operation, the moved-up thermal head 14 moves down so as to close to the platen 13. Accordingly, the thermal head 14 and the platen 13 sandwich the roll paper 1 and the ink ribbon 16 together, so that they are brought into contact with the platen 13 by the thermal head 14.

Here, in the thermal head 14, a plurality of heating elements (heating resistors) is arranged in a line shape along the width direction (line direction) of the roll paper 1. Accordingly, when the roll paper 1 and the ink ribbon 16 are sandwiched together by the thermal head 14 and the platen 13, the heating resistors of the thermal head 14 are brought into contact with the roll paper 1 through the ink ribbon 16 on the platen 13.

In this state, when image data for a printing image is input, the roll paper 1 is sequentially transported by the rotational driving operation of the grip roller 15*a*. In addition, the ink ribbon 16 is sequentially wound at the same speed as that of the roll paper 1 by the rotational driving operation of the winding reel 17*b*. At the same time, the heating resistors arranged in the thermal head 14 are selectively electrified to be driven by a driving control signal, so that thermal energy is applied from the heating resistors to the ink ribbon 16. Then, in response to the heating amount of the heating resistors of the thermal head 14, the dye ink on the ink ribbon 16 is sublimated so as to be thermally transferred onto the roll paper 1.

By repeating this operation for each transfer layer, a color printing operation is performed on the roll paper 1. That is, the color material layer of each color and the protection layer for the lamination process are sequentially thermally transferred onto the roll paper 1 so as to form an image on the roll paper 1.

Likewise, in the roll paper 1, a color printing operation is performed on the roll paper 1 by an operation of a printing unit including the thermal head 14 and the platen 13.

Then, the printed portion of the roll paper 1 subjected to the printing operation is cut into a predetermined size by a cutter, and is discharged from a discharge opening onto a discharge tray.

Configuration Example of Main Part of Printing Apparatus

Subsequently, a configuration example of a head mechanism including the thermal head 14 will be described as a configuration example of a main part of the printer.

Figure 2B:
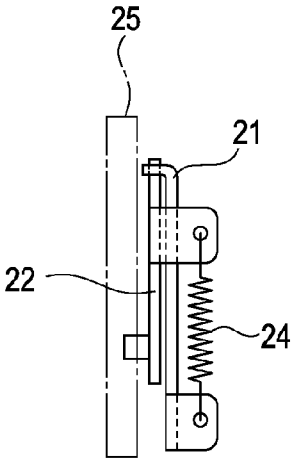
FIGS. 2A and 2B are explanatory diagrams showing a configuration example of a main part of the printer according to the invention.
Figure 2A:
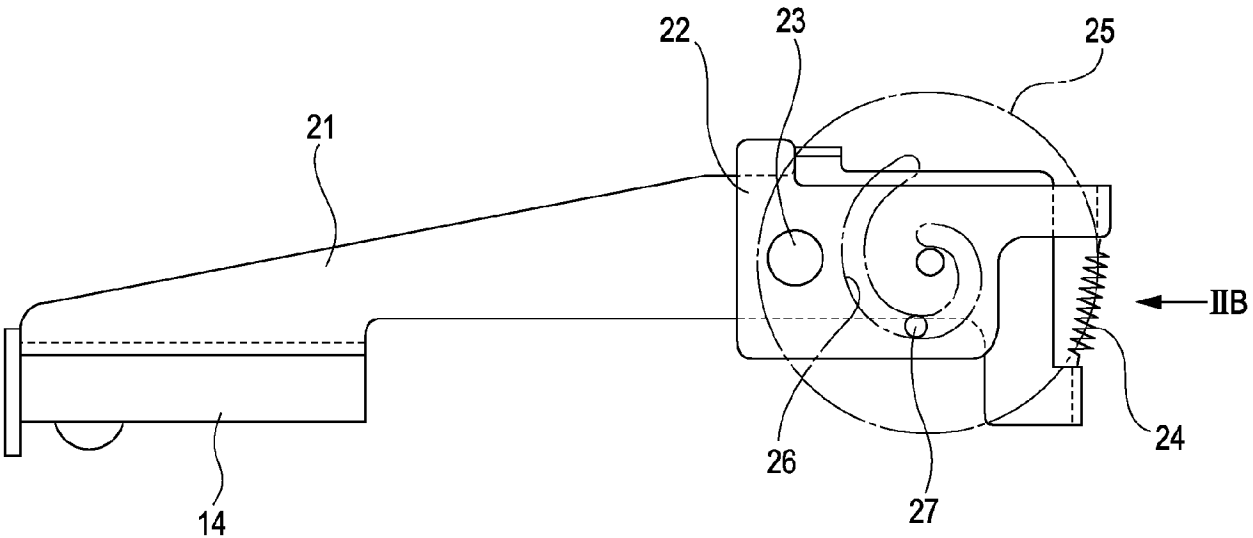

FIGS. 2A and 2B are explanatory diagrams showing a configuration example of a main part of the printer according to the invention.

In the head mechanism shown in the example, the thermal head 14 is attached to a head support plate 21.

The head support plate 21 is tiltably supported by a support shaft 23 protruding from a base member (not shown). In addition, the thermal head 14 is attached to one end thereof, and a coil spring 24 is connected to the other end thereof.

Further, in addition to the head support plate 21, a head pressure plate 22 is tiltably supported by the support shaft 23. In addition, the coil spring 24 is connected to one end of the head pressure plate 22. By means of the urging force of the coil spring 24, the head support plate 21 is tilted in accordance with the head pressure plate 22.

In addition, the head pressure plate 22 is provided with a pin 27 which is fitted and guided by a cam groove 26 of a head driving cam 25.

The head driving cam 25 is rotationally driven by a driving source (not shown). The cam groove 26 provided in the head driving cam 25 has a profile such that a distance from the rotation center of the head driving cam 25 is changed in response to the rotation angle of the head driving cam 25.

Accordingly, when the head driving cam 25 is rotated in the state where the pin 27 of the head pressure plate 22 follows the cam groove 26 of the head driving cam 25, the head pressure plate 22 is tilted about the support shaft 23. In addition, the head support plate 21 is tilted about the support shaft 23 so as to follow the head pressure plate 22. Accordingly, the head support plate 21 allows the thermal head 14 attached to one end thereof to displace in the vertical direction. That is, a structure is obtained in which the operation control is performed by means of the rotation of the head driving cam 25 so that the thermal head 14 moves down to the platen 13 and moves up to a position distant from the platen 13.

When the thermal head 14 moves down to the platen 13, they sandwich the roll paper 1 and the ink ribbon 16. The sandwiching force obtained at this time, that is, the pressure from the thermal head 14 to the platen 13 is determined depending on the deformation amount (bending amount) of the coil spring 24 connecting the head support plate 21 and the head pressure plate 22 to each other. The deformation amount of the coil spring 24 is controlled by the rotation of the head driving cam 25 as described below in detail.

In addition, herein, a case has been exemplified in which the head mechanism has a structure including the head driving cam 25, but the head mechanism may have different structures if the up/down movement operation of the thermal head 14 and the pressure generated by the thermal head 14 can be controlled. As an example of the different structures, a structure may be exemplified in which the thermal head 14 is directly moved up and down by a driving source such as an electronic solenoid.

Configuration Example of Printing Target Medium

Next, a configuration example of the roll paper 1 used as a printing target medium in the printer having the above-described configuration will be simply described.

FIGS. 3A, 3B, and 3C are explanatory diagrams showing a detailed configuration example of the roll paper used as a printing target medium.

As shown in FIG. 3A, the roll paper 1 used as the printing target medium has a structure in which a dye storing layer 3 storing at least a color material (dye ink) is formed on a support member 2 as a base. In addition, an air gap layer having a heat insulation function is provided as an intermediate layer 4 between the support member 2 and the dye storing layer 3. The intermediate layer 4 keeps heat generated from the thermal head 14 for the purpose of highly efficiently obtaining thermal energy necessary for the transfer operation of the color material layer. Accordingly, as the intermediate layer 4, for example, a film provided with air gaps formed by adding microscopic particles to a thermoplastic resin and two-axially stretching the result, or a layer coated with a result formed by mixing hollow particles with a binder resin is used.

The roll paper 1 having the above-described configuration may be formed in accordance with the following sequence. First, as the support member 2, for example, an art paper having a thickness of 150 μm is used. Then, one surface thereof is provided with the intermediate layer 4 which is formed by coating and drying an intermediate layer coating liquid having a composition, for example, shown in FIG. 3B so that a solid content coating amount is 40 $g/m^2$. In addition, the base obtained after coating and drying the intermediate layer 4 is provided with the dye storing layer 3 which is formed by coating and drying a dye storing layer coating liquid having a composition, for example, shown in FIG. 3C so that a solid content coating amount is 5 $g/m^2$ and hardening the result at 50° C. for 48 hours.

In addition, the roll paper 1 used as the printing target medium is not limited to the above-described configuration, but may have other configurations if sublimation dye ink can be used.

Process Operation Example of Printing Apparatus

Next, a process operation example of the printer having the above-described configuration will be described.

FIGS. 4A to 5B are explanatory diagrams showing an outline of the process operation example of the printer according to the invention.

Figure 4A:
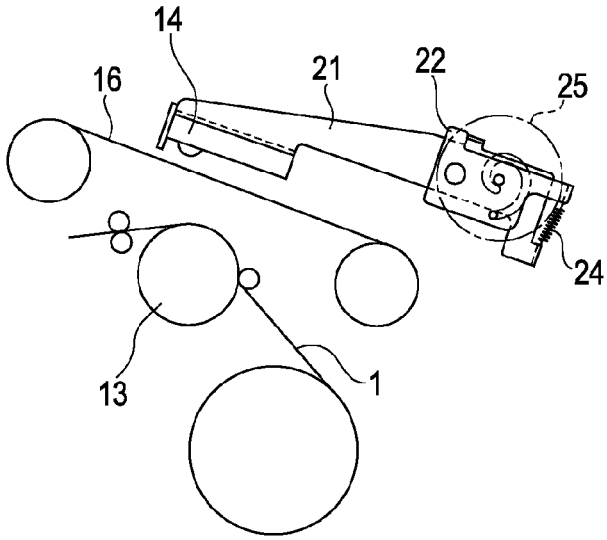
FIGS. 4A, 4B, and 4C are (first) explanatory diagrams showing an outline of a process operation example of the printer according to the invention.

FIG. 4A shows a state where the thermal head 14 moves up to a position distant from the platen 13. In this state, when the head driving cam 25 is rotated, the position of the pin 27 of the head pressure plate 22 is controlled in accordance with the cam groove 26 of the head driving cam 25 so as to displace in a direction coming close to the rotation center of the head driving cam 25. When the head pressure plate 22 is tilted in response to the displacement, the head pressure plate 22 is tilted by the urging force of the coil spring 24. Accordingly, the head support plate 21 is tilted in a direction in which the thermal head 14 comes close to the platen 13.

Figure 4B:
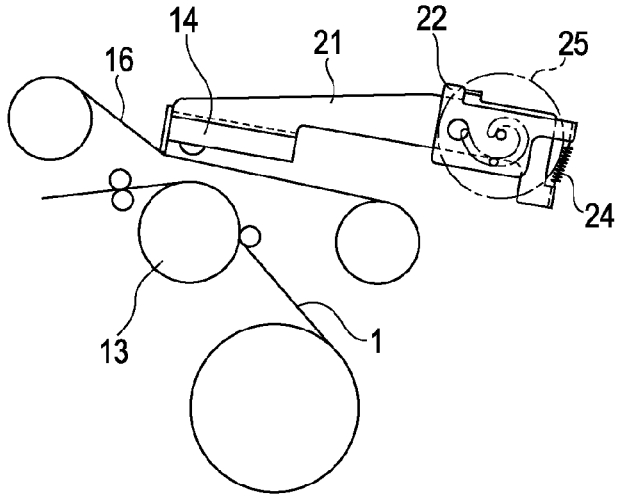

FIG. 4B shows a state of the start mark of the ink ribbon 16. In the ink ribbon 16, the color material layer and the protection layer are formed in a line on the sheet in the travel direction. Accordingly, in the case where the thermal head 14 moves down to the platen 13 so as to sandwich the roll paper 1 and the ink ribbon 16 together, the start mark is marked on the protection layer or the color material layer to be transferred before the sandwiching operation. When the start mark is marked in accordance with each of the color material layer or the protection layer, it is possible to clarify the color material layer or the protection layer to be transferred subsequently after the start mark. In addition, the start mark may be marked by using, for example, an existing technology which uses an index mark disposed on the ink ribbon 16.

Figure 4C:
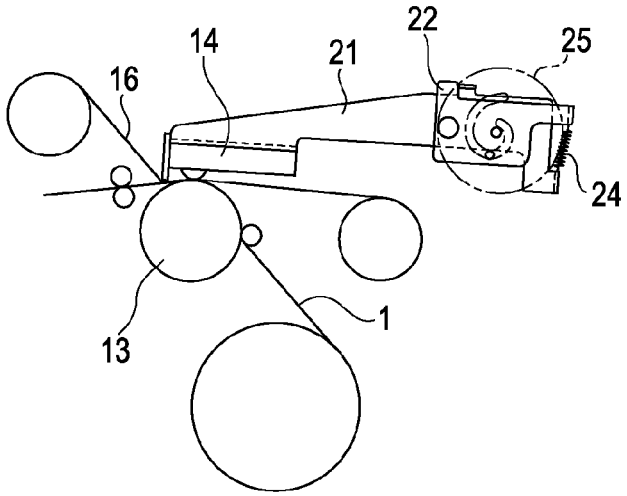

FIG. 4C shows a state where the thermal head 14 moves down to arrive at the outer peripheral surface of the platen 13. Until this state, the head support plate 21 is tilted in accordance with the rotation of the head driving cam 25. In addition, when the thermal head 14 arrives at the outer peripheral surface of the platen 13, the roll paper 1 and the ink ribbon 16 are sandwiched.

Figure 5A:
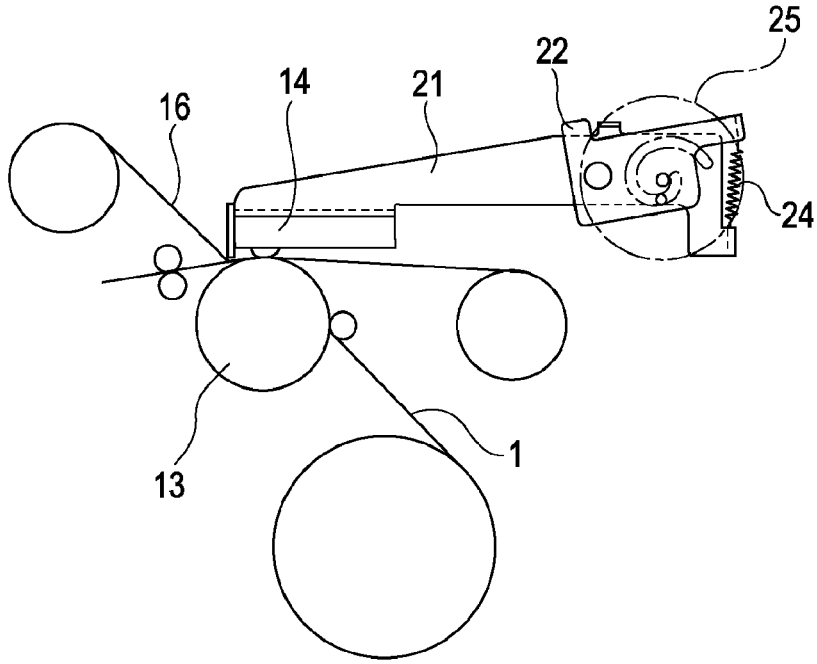
FIGS. 5A and 5B are (second) explanatory diagrams showing an outline of a process operation example of the printer according to the invention.

FIG. 5A shows a state where the color material layer of yellow, magenta, or cyan is transferred from the ink ribbon 16 to the roll paper 1. In this state, the head driving cam 25 is rotated further by a predetermined amount from the state shown in FIG. 4C. At this time, the head pressure plate 22 is tilted in response to the rotation amount of the head driving cam 25. However, since the thermal head 14 has already arrived at the outer peripheral surface of the platen 13, even when the head driving cam 25 is rotated, the head support plate 21 is not tilted any more. For this reason, when the head driving cam 25 is rotated only by a predetermined amount, there is a difference between the tilting angles of the head support plate 21 and the head pressure plate 22, and the coil spring 24 connecting them each other is deformed (bent) by a degree corresponding to the difference. Likewise, when the coil spring 24 is deformed, a pressure in response to the deformation amount is applied to the thermal head 14 attached to the head support plate 21 on the basis of Hooke's law. That is, a pressure in response to the deformation amount of the coil spring 24 is applied to the thermal head 14.

At this time, the pressure generated by the thermal head 14, that is, the sandwiching force applied to the roll paper 1 and the ink ribbon 16 is denoted by a "force P1" in the case of the thermal transferring operation of the color material layer. The force P1 is determined in advance in response to the specification of the printer, and more particularly, the heating elements in the thermal head 14 or the roll paper 1 in use. In detail, for example, it may be set such that the force P1=1.2 MPa. In addition, the setting value of the force P1 herein is merely a detailed example, and of course, is not limited thereto.

Figure 5B:
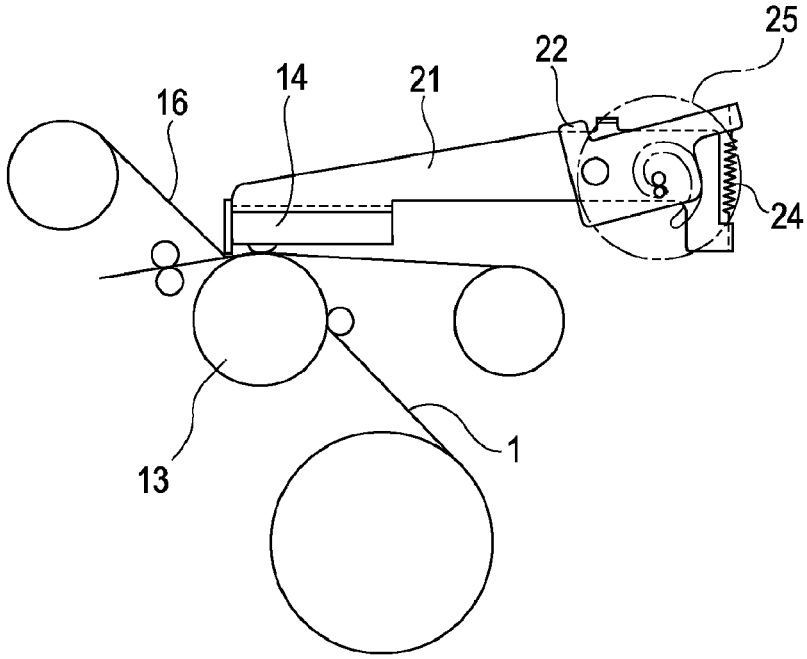

FIG. 5B shows a state where the protection layer for the lamination process is transferred from the ink ribbon 16 to the roll paper 1. In this state, the head driving cam 25 is rotated further by a predetermined amount from the state shown in FIG. 5A. That is, the head driving cam 25 is further rotated compared with the case of thermal transferring the color material layer. Accordingly, the head support plate 21 is not tilted any more, but the head pressure plate 22 is further tilted, which further increases the deformation amount of the coil spring 24 connecting them each other. Thus, in the case of transferring the protection layer, a larger pressure is applied to the thermal head 14 on the basis of Hooke's law compared with the case of transferring the color material layer.

At this time, the pressure generated by the thermal head 14, that is, the sandwiching force acting on the roll paper 1 and the ink ribbon 16 is denoted by a "force P2" in the case of the thermal transfer operation of the protection layer. The force P2 is supposed to be determined in advance so as to satisfy a relationship of force P1<force P2. However, the upper limit of the setting value is set within a range in which there is no adverse influence acting on the roll paper 1 or the like (for example, the roll paper 1 is not excessively trampled or the travel of the roll paper 1 is not disturbed) during the transfer operation of the protection layer. In detail, for example, it is set so that force P1=1.8 MPa is satisfied. In addition, the setting value of the force P2 herein is merely a detailed example as in the force P1, and of course, is not limited thereto.

As described above, in the cases of the transfer operations of the color material layer and the protection layer, the pressure generated by the thermal head 14 is made to be different for each case. In addition, the force P1 in the case of the thermal transfer operation of the color material layer and the force P2 in the case of the thermal transfer operation of the protection layer are set to have a relationship of force P1<force P2. That is, in the cases of the transfer operations of the color material layer and the protection layer, the sandwiching force acting on the roll paper 1 and the ink ribbon 16 is changed so as to satisfy force P1<force P2.

The sandwiching force acting on the roll paper 1 and the ink ribbon 16 is changed through a rotation control of the head driving cam 25. That is, the sandwiching force acting on the roll paper 1 and the ink ribbon 16 is changed by making the rotation angle of the head driving cam 25 different in the cases of the transfer operations of the color material layer and the protection layer. Accordingly, the driving source for rotationally driving the head driving cam 25 and the controller for controlling the driving state of the driving source serve as a pressure changing mechanism for changing the sandwiching force.

Figure 6A:
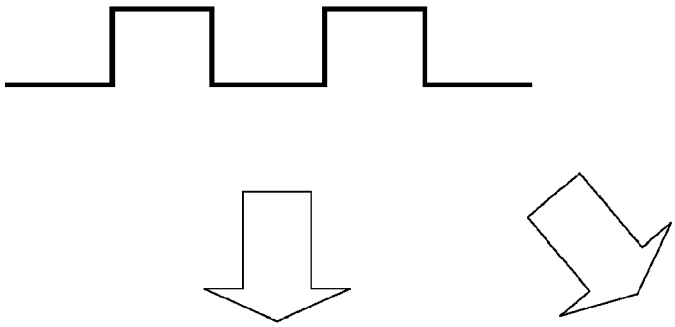
FIGS. 6A, 6B, and 6C are explanatory diagrams schematically showing a detailed example of a surface state of the printing target medium after thermal transfer.
Figure 6B:
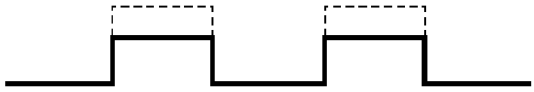
Figure 6C:
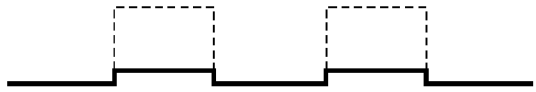

FIGS. 6A, 6B and 6C are explanatory diagrams schematically showing a detailed example of a surface state of the printing target medium after the thermal transfer operation.

FIG. 6A schematically shows a surface state of the roll paper 1 after performing the thermal transfer operation of the color material layer. As described above, in the case of the thermal transfer operation of the color material layer, there is a difference between the thermal energies applied to the high density image portion and a low density image portion. Accordingly, after the thermal transfer operation of the color material layer, for example, unevenness may be generated at the boundary of the image density such that a crushing degree at the high density image portion is large and a crushing degree at the low density image portion is small.

The thermal transfer operation of the protection layer is performed subsequently after the thermal transfer operation of the color material layer.

FIG. 6B schematically shows a surface state of the roll paper after performing the thermal transfer operation of the protection layer through a general technique. In the case of the thermal transfer operation of the protection layer, thermal energy generated from the thermal head 14 and a pressure generated from the thermal head 14 are applied to the roll paper 1. At this time, generally, the force P1 in the case of the thermal transfer operation of the color material layer and the force P2 in the case of the thermal transfer operation of the protection layer have a relationship of force P1=force P2. Accordingly, even when the thermal transfer operation of the protection layer is performed, the unevenness generated in the thermal transfer operation of the color material layer may be more or less smoothened, but is not completely removed from the roll paper 1.

FIG. 6C schematically shows a surface state of the roll paper 1 after performing the thermal transfer operation of the protection layer through a technique described in the embodiment. In the technique described in the embodiment, the force P1 in the case of the thermal transfer operation of the color material layer and the force P2 in the case of the thermal transfer operation of the protection layer have a relationship of force P1<force P2.

The unevenness generated in the thermal transfer operation of the color material layer is smoothened by the thermal energy and the sandwiching force applied during the thermal transfer operation of the protection layer. That is, when the smoothening process of the unevenness is also performed during the thermal transfer operation of the protection layer, it is possible to remarkably suppress the generation of the unevenness compared with the case of the above-described general technique.

As described above, in the printer of the embodiment, the protection layer is thermally transferred onto the roll paper 1 after the color material layer is thermally transferred onto the roll paper 1. At this time, there is a difference between the thermal energies applied to the high density image portion and the low density image portion in the case of the thermal transfer operation of the color material layer, but a uniform thermal transfer operation is performed on the entire surface of the printing target medium in the case of the thermal transfer operation of the protection layer. Further, the force P1 in the case of the thermal transfer operation of the color material layer and the force P2 in the case of the thermal transfer operation of the protection layer have a relationship of force P1<force P2. Accordingly, even when unevenness is generated at the boundary between the high density image portion and the low density image portion in the case of the thermal transfer operation of the color material layer, the unevenness is smoothened by the thermal energy and the sandwiching force applied in the case of the thermal transfer operation of the protection layer. In addition, since the smoothening operation is performed during the thermal transfer operation of the protection layer, it is not necessary to further prepare a process step for the smoothening operation in addition to the thermal transfer operations of the color material layer and the protection layer.

That is, according to the printer of the embodiment, the unevenness which may be generated on the roll paper 1 during the thermal transfer operation of the color material layer is smoothened during the thermal transfer operation of the protection layer. Accordingly, in the case of performing a printing operation through the thermal transfer technique, even when there is a difference between the thermal energies applied to the high density image portion and the low density image portion during the thermal transfer operation of the color material layer, it is possible to suppress the generation of the unevenness at the boundary of the image densities caused by the difference. Further, since the smoothing operation is performed during the thermal transfer operation of the protection layer, the printing productivity is not degraded due to the thermal transfer operation.

2. Second Embodiment

Next, a second embodiment of the invention will be described. However, herein, the points different from the above-described first embodiment will be mainly described.

For example, in a photographic print, matt finishing may be exemplified as one of methods of improving an added value. In the matt finishing in the silver halide photography, microscopic unevenness is formed on a surface so as to generate scattering of light and to reduce regularly reflected light. Accordingly, image clarity is reduced while maintaining micro gloss of the surface, and hence a high-quality image is obtained. In particular, the matt finishing is means for giving a high quality feeling to a broad paper surface of a portrait size or the like. Even in the sublimation-type thermal transfer printing method, the matt finishing is in demand.

In order to meet such a demand, as the sublimation-type thermal transfer printing technology for the matt finishing, for example, there is proposed a technology which presses an embossing plate having an uneven surface against the protection layer under the heating condition (for example, refer to JP-A-2006-182012). However, in the method, for the operation of pressing the embossing plate, a large configuration other than the printer or a process separate from the printing operation of the printer is necessary. For this reason, the method is difficult to be used from the viewpoint of cost or productivity.

In addition, as another sublimation-type thermal transfer printing technology, for example, there is proposed a technology in which unexpanded synthetic thermoplastic high polymer microscopic spherical bodies each having a particle diameter of about 5 to 20 μm are contained in a material of forming the protection layer, and the particle diameters of the microscopic spherical bodies are expanded to be about 20 to 120 μm by a heat generated during the transfer operation of the protection layer (for example, refer to JP-A-2000-153674). However, in the method, it is not possible to obtain unevenness on the surface necessary for the matt finishing, and to obtain the matt tone similar to the silver halide photography. In addition, since the microscopic spherical bodies are contained in the protection layer, the matt surface is obtained. For this reason, it is not possible to selectively use the glossy finishing or matt finishing depending on the situation.

Further, as still another sublimation-type thermal transfer printing technology, for example, there is proposed a technology in which a heating amount during the thermal transfer operation is changed by using a protection layer formed by a thermoplastic resin and an inorganic layer-like compound so as to change a glossy amount of a surface of the protection layer (for example, refer to JP-A-2004-106260). However, in the method, there is only a difference in gloss of the surface, and it is not possible to obtain the unevenness of a surface necessary for the matt finishing. As a result, it is not possible to obtain the matt tone substantially having the same level as that of the silver halide photography.

In consideration of the above-described circumstances, in the second embodiment described herein, it is possible to reliably obtain the matt tone substantially having the same level as that of the silver halide photography without degrading the benefit of the cost or the productivity. For this reason, in the printer of the second embodiment, as described in the first embodiment, the process operation is performed so that the force P1 in the case of the thermal transfer operation of the color material layer and the force P2 in the case of the thermal transfer operation of the protection layer have a relationship of force P1<force P2.

Figure 7:
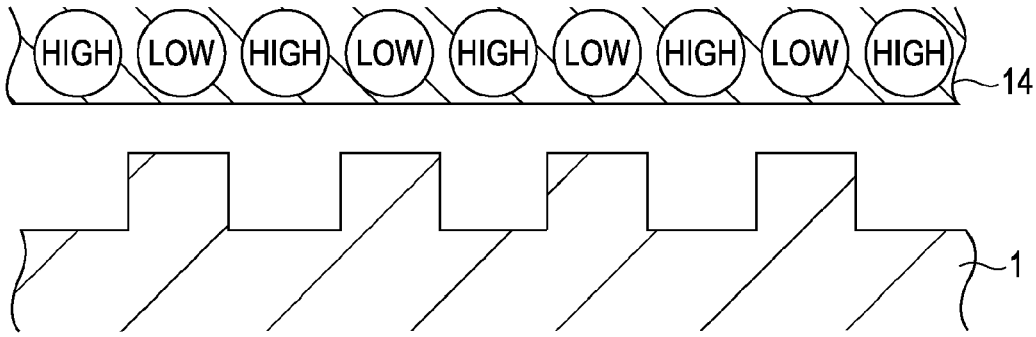
FIG. 7 is an explanatory diagram showing an outline of a process operation example according to a second embodiment of the invention.

FIG. 7 is an explanatory diagram showing an outline of the process operation example of the second embodiment of the invention.

In the printer of the embodiment, in the case of the thermal transfer operation of the protection layer, the thermal energy applied from the thermal head 14 is selectively changed. In detail, as shown in the drawing, the heating resistors of the thermal head 14 arranged in a line shape are electrified to be driven so that a low thermal energy application portion and a high thermal energy application portion alternately exist every predetermined number (for example, one). In addition, the heating resistors are electrified to be driven so as to repeat a low thermal energy application state and a high thermal energy application state whenever the roll paper 1 and the ink ribbon 16 are transported by a predetermined amount. Likewise, in the case of the thermal transfer operation of the protection layer, the thermal energy applied from the thermal head 14 is selectively changed so that the low thermal energy application portion and the high thermal energy application portion are mixed in a predetermined pattern (for example, a lattice pattern) in the primary scanning direction and the secondary scanning direction.

The selective change of the thermal energy applied from the thermal head 14 may be performed by the electrification driving control of the heating resistors of the thermal head 14. That is, when the driving voltage value is newly changed upon electrifying the heating resistors to be driven, the thermal energy generated by the heating resistors is changed. Accordingly, the controller for performing the electrification driving control for the heating resistors in the thermal head 14 serves as a printing control unit for selectively changing the thermal energy generated from the thermal head 14.

The driving voltage values for the heating resistors are supposed to be determined in advance in the low thermal energy application state and the high thermal energy application state. In detail, it may be supposed that at least two different driving voltage values are appropriately set for the low thermal energy and the high thermal energy in the range in which the voltage value capable of performing the thermal transfer operation of the protection layer is set to the lower limit value, and the voltage value not causing damage on the surface state after the thermal transfer operation is set to the upper limit value.

Likewise, when thermal energy of the heating resistors of the thermal head 14 is selectively changed, an uneven pattern is formed on the surface of the roll paper 1 after the transfer operation of the protection layer. The crushing amount of the roll paper 1 is different in proportion to the magnitude of the thermal energy. That is, an uneven pattern is formed on the roll paper 1 so as to correspond to the mixed pattern of the low thermal energy application portion and the high thermal energy application portion. The uneven pattern corresponds to microscopic unevenness formed on the surface for the matt finishing.

Incidentally, the force P1 in the case of the thermal transfer operation of the color material layer and the force P2 in the case of the thermal transfer operation of the protection layer have a relationship of force P1<force P2. Accordingly, the crushing amount of the roll paper 1 in the case of the thermal transfer operation of the protection layer increases compared with the case of the relationship of force P1=force P2.

This means that the uneven pattern can be easily formed during the transfer operation of the protection layer by increasing the crushing amount of the roll paper 1 during the transfer operation of the protection layer. That is, when the pressure generated by the thermal head 14 during the transfer operation of the protection layer is increased, it is possible to form the uneven pattern for the clear matt finishing.

As described above, in the printer of the embodiment, the uneven pattern for the matt finishing is formed on the roll paper 1 by selectively changing the thermal energy from the thermal head 14 while increasing the pressure of the thermal head 14 during the transfer operation of the protection layer. For this reason, the unevenness which may be generated during the thermal transfer operation of the color material layer can be smoothened, and the uneven pattern for the clear matt finishing can be formed during the transfer operation of the protection layer. That is, it is possible to reliably form the uneven pattern for the matt finishing during the transfer operation of the protection layer regardless of whether unevenness is generated during the thermal transfer operation of the color material layer.

Thus, according to the printer of the embodiment, since it is possible to obtain the unevenness of the surface necessary for the matt finishing, it is possible to realize the matt finishing substantially having the same level as that of the silver halide photography. In addition, since the method does not use a large configuration or a separate process, the method is very suitable from the viewpoint of cost and productivity. Further, since the uneven pattern for the matt finishing is formed through the control of the thermal energy during the transfer operation of the protection layer, it is possible to easily perform glossy finishing or matt finishing depending on the situation.

3. Third Embodiment

Next, a third embodiment of the invention will be described. However, herein, the points different from the above-described second embodiment will be mainly described.

In the printer according to the third embodiment, as described in the second embodiment, the following process operation is performed in addition to the operation of selectively changing the thermal energy from the thermal head 14 during the transfer operation of the protection layer. That is, in the printer of the embodiment, the transportation speed of the roll paper 1 in the case of the thermal transfer operation of the protection layer is set to be slower than the transportation speed of the roll paper 1 in the case of the thermal transfer operation of the color material layer.

The transportation speed of the roll paper 1 may be newly changed through a driving control for the grip roller 15*a* and the pinch roller 15*b* for transporting the roll paper 1. That is, the transportation speed of the roll paper 1 is changed by newly changing the rotation speed upon driving the grip roller 15*a* and the pinch roller 15*b*. Accordingly, the driving source for rotationally driving the grip roller 15*a* and the pinch roller 15*b* and the controller for controlling the driving state of the driving source serve as a transportation control unit for changing the transportation speed of the roll paper 1.

In addition, the transportation speed of the roll paper 1 is set in advance for each of the transfer operations of the color material layer and the protection layer. For example, the transportation speed during the transfer operation of the color material layer may be set to 0.7 msec/line in consideration of the printing productivity. In addition, the transportation speed during the transfer operation of the protection layer may be set to a value within a range of 3.0 to 5.0 msec/line as a speed capable of obtaining a sufficient matt effect, and desirably set to 4.0 msec/line. However, the setting value mentioned herein is merely a detailed example, and of course, is not limiting.

In addition, in the cases of the transfer operations of the color material layer and the protection layer, the ink ribbon 16 also moves between the thermal head 14 and the platen 13 together with the roll paper 1. Accordingly, the traveling speed of the ink ribbon 16 is changed in accordance with a variation in the transportation speed of the roll paper 1. The travel speed of the ink ribbon 16 may be changed by newly changing the rotation speed upon driving the supply reel 17*a* and the winding reel 17*b*.

Likewise, when the transportation speed in the case of the thermal transfer operation of the protection layer is set to be slower than the transportation speed in the case of the thermal transfer operation of the color material layer by changing the transportation speed of the roll paper 1, it is possible to spend more time on the transfer operation of the protection layer compared with the transfer operation of the color material layer. That is, it is possible to increase the time for the transfer operation of the protection layer compared with the case where the transportation speed during the transfer operation of the protection layer is equal to the transportation speed during the transfer operation of the color material layer.

When it is possible to increase the time for the thermal transfer operation, much thermal energy can be applied from the thermal head 14 without causing an increase in the thermal energy per unit time. Accordingly, when the time for the transfer operation of the protection layer is increased, it is possible to give much thermal energy compared with the case of the thermal transfer operation of the color material layer, and thus to form the uneven pattern for the clear matt finishing. Further, since the thermal energy per unit time does not excessively increase, the surface of the roll paper 1 during the transfer operation of the protection layer may not be damaged.

In addition, since the transportation speed of the roll paper 1 is set to be slow only during the transfer operation of the protection layer, it is possible to suppress the deterioration in the printing productivity compared with the case where the transportation speed is slow in both cases of the transportation operations of the color material layer and the protection layer.

As described above, in the printer of the embodiment, since the transportation speed of the roll paper 1 during the transfer operation of the protection layer is set to be slower than that during the transfer operation of the color material layer, the total thermal energy during the transfer operation of the protection layer is increased compared with the case where the transportation speed is not changed. Accordingly, it is possible to form the uneven pattern for the clear matt finishing compared with the case where the transportation speed is not changed. As a result, it is possible to realize the matt tone substantially having the same level as that of the silver halide photography. Further, for this reason, the printed surface is not damaged, and the printing productivity is not extremely degraded.

Example 1

4. Detailed Example

Herein, a matt image evaluation result and a dent evaluation result of printed matter obtained by the printers of the first to third embodiments will be described by exemplifying a detailed example.

FIG. 8 is an explanatory diagram showing a detailed example of the matt image evaluation result and the dent evaluation result of the printed matter obtained by the printer according to the invention.

In the example shown in the drawing, all cases show the evaluation results obtained upon printing a general photographic image at a resolution of, for example, 334 dpi on the roll paper 1 having a configuration described by referring to FIGS. 3A, 3B, and 3C by using the thermal transfer sheet as the ink ribbon 16 having the dye ink layer for each of yellow, magenta, and cyan and the protection layer for the lamination process.

The configuration of the first embodiment shows a case where the head pressure during the transfer operation of the color material layer is 1.2 MPa and the head pressure during the transfer operation of the protection layer is 1.8 MPa. In addition, the head pressure may be checked and measured by using, for example, a prescale (manufactured by Fujifilm and corresponding to a film of which the color turns red when receiving a pressure and the density changes in response to the pressure applied thereto). Further, the printing speed during the transfer operation of the protection layer is equal to that during the transfer operation of the color material layer, where the speed is 0.7 msec/line. Furthermore, the transfer pattern of the protection layer is gloss (the thermal energy for each of the heating elements of the thermal head 14 is uniform).

The configuration of the second embodiment shows a case where the head pressure during the transfer operation of the color material layer is 1.2 MPa and the head pressure during the transfer operation of the protection layer is 1.8 MPa. In addition, the printing speed during the transfer operation of the protection layer is equal to the printing speed during the transfer operation of the color material layer, where the printing speed is 0.7 msec/line. Further, the transfer pattern of the protection layer is a matt (a lamination pattern in which the thermal energy of the heating elements of the thermal head 14 is selectively changed).

The configuration of the third embodiment shows a case where the head pressure during the transfer operation of the color material layer is 1.2 MPa and the head pressure during the transfer operation of the protection layer is 1.8 MPa. In addition, the printing speed during the transfer operation of the color material layer is 0.7 msec/line, but the printing speed during the transfer operation of the protection layer is low so as to be 4.0 msec/line. However, at the low transportation speed, the strobe pulse width is adjusted so as to obtain the same recording density characteristic for each layer tone as the high transportation speed (0.7 msec/line). Further, the transfer pattern of the protection layer is a matt (a lamination pattern in which the thermal energy of the heating elements of the thermal head 14 is selectively changed).

In addition, in the example shown in the drawing, comparative examples 1 to 3 are shown for comparison with the embodiments. The comparative examples 1 to 3 are different from the first to third embodiments in that the head pressure during the transfer operations of the color material layer and the protection layer is 1.2 MPa. However, the other conditions correspond to the cases of the first to third embodiments.

In the dent evaluation of the printed matter, the printing operation is performed on the roll paper 1 in accordance with the above-described conditions, and it is determined whether a dent is formed on the printed matter with eyes. In the drawing, the mark ○ denotes a state where a stepped portion is not found at the boundary between the high density image portion and the low density image portion. The mark Δ denotes a defective state where a stepped portion is found at the boundary between the high density image portion and the low density image portion. The mark x denotes a defect state where a large stepped portion is found at the boundary between the high density image portion and the low density image portion.

As the dent evaluation result of the printed matter, in the first embodiment, it is understood that the stepped portion formed at the boundary between the high density image portion and the low density image portion during the transfer operation of the color material layer is removed by increasing the head pressure during the transfer operation of the protection layer. On the contrary, in the comparative example 1, since the head pressure during the transfer operation of the protection layer is low, the stepped portion formed during the transfer operation of the color material layer is not removed.

In the matt image evaluation, the printing operation is performed on the roll paper 1 in accordance with the above-described conditions, and it is determined whether the matt image is formed on the surface of the printed matter with eyes. In the drawing, the mark © denotes a state where the matt tone is realized like the silver halide photography, and the matt tone is very satisfactory. The mark ○ denotes a state where the matt tone is slightly inferior to the silver halide photography, but the matt tone is satisfactory. The mark x denotes a defect state where the matt tone is different from the silver halide photography, and the matt feeling is too strong.

As the matt image evaluation result, in the second embodiment, the matt tone similar to the silver halide photography is realized by selectively changing the thermal energy while increasing the head pressure during the transfer operation of the protection layer. In addition, in the third embodiment, it is understood that a more desirable matt tone is realized by further decreasing the printing speed. On the contrary, in the comparative examples 2 and 3, the matt pattern is printed during the transfer operation of the protection layer, but a desired unevenness is not obtained. This is because most of the air gap layer is crushed during the transfer operation of the color material layer, and unevenness corresponding to the thermal energy is not formed. Meanwhile, in the second and third embodiments, the air gap layer is crushed during the transfer operation of the color material layer as the above-described movement, but the air gap layer of the uncrushed area can be crushed by increasing the head pressure during the transfer operation of the protection layer. Accordingly, in the second and third embodiments, it is possible to form the uneven pattern for the matt finishing compared with the comparative examples 2 and 3.

In addition, in the above-described embodiments and example, the preferred and detailed examples of invention have been described, but the invention is not limited thereto.

For example, the shape, the material, the movement direction of each of the constituents exemplified in the embodiments are merely detailed examples, but the invention is not limited to the exemplified contents.

The present application contains subject matter related to that disclosed in Japanese Priority Patent Application JP 2009-143969 filed in the Japan Patent Office on Jun. 17, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A printing apparatus comprising:

a medium transporting unit configured to transport a printing target medium;

a sheet traveling unit configured to allow a thermal transfer sheet, in which a color material layer and a protection layer are formed on a sheet in a line along a travel direction, to travel;

a printing unit configured to sequentially and thermally transfer the color material layer and the protection layer onto the printing target medium by applying thermal energy to the printing target medium and the thermal transfer sheet which are sandwiched by the printing unit; and a pressure changing mechanism configured to change the sandwiching force acting on the printing target medium and the thermal transfer sheet so as to have a relationship of force P1<force P2, where the force P1 is a force during a thermal transfer operation of the color material layer, and the force P2 is a force during a thermal transfer operation of the protection layer.

2. The printing apparatus according to claim 1, further comprising:

a printing control unit configured to form an uneven pattern on the printing target medium subjected to the thermal transfer operation of the protection layer by selectively changing the thermal energy applied by the printing unit during the thermal transfer operation of the protection layer.

3. The printing apparatus according to claim 2, further comprising:

a transportation control unit configured to allow a transportation speed of the printing target medium transported by the medium transporting unit during the thermal transfer operation of the protection layer to be slower than a transportation speed of the printing target medium transported by the medium transporting unit during the thermal transfer operation of the color material layer.

4. A thermal printing method comprising the steps of:

applying thermal energy to a printing target medium and a thermal transfer sheet having at least a color material layer formed thereon while sandwiching the printing target medium and the thermal transfer sheet so as to thermally transfer the color material layer onto the printing target medium;

applying thermal energy to the printing target medium and the thermal transfer sheet having at least a protection layer formed thereon while sandwiching the printing target medium and the thermal transfer sheet after the thermal transfer operation of the color material layer so as to thermally transfer the protection layer onto the printing target medium; and changing the sandwiching force acting on the printing target medium and the thermal transfer sheet so as to have a relationship of force P1<force P2, where the force P1 is a force during the thermal transfer operation of the color material layer, and the force P2 is a force during the thermal transfer operation of the protection layer.

* * * * *